US008759703B2

(12) United States Patent
Wang et al.

(10) Patent No.: US 8,759,703 B2
(45) Date of Patent: Jun. 24, 2014

(54) SWITCH WITH REDUCED CONTACTING AREAS BETWEEN ACTUATOR AND INSULATIVE HOUSING

(75) Inventors: Yong-Jia Wang, Shenzhen (CN); Liang Sun, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 278 days.

(21) Appl. No.: 13/279,530

(22) Filed: Oct. 24, 2011

(65) Prior Publication Data

US 2012/0097509 A1 Apr. 26, 2012

(30) Foreign Application Priority Data

Oct. 26, 2010 (CN) ..... 2010 2 0576941

(51) Int. Cl.
*H01H 13/70* (2006.01)

(52) U.S. Cl.
USPC ..... 200/345; 200/406

(58) Field of Classification Search
USPC ..... 200/345, 406
See application file for complete search history.

(56) References Cited

U.S. PATENT DOCUMENTS 7,745,744 B2 * 6/2010 Nakase et al. ..... 200/6 A

FOREIGN PATENT DOCUMENTS

JP 4246119 4/2009

* cited by examiner

*Primary Examiner* — Renee Luebke
*Assistant Examiner* — Lheiren Mae Caroc
(74) *Attorney, Agent, or Firm* — Ming Chieh Chang; Wei Te Chung

(57) ABSTRACT

A switch includes an insulative housing, a fixed contact, a movable contact and an actuator. The insulative housing defining a receiving cavity enclosed by a number of peripheral walls each of which includes an inner surface exposed to the receiving cavity. The actuator includes a bottom portion slidably received in the receiving cavity, a bottom operator for deforming of the moveable contact and a button. The bottom portion includes a first side wall and a first rib protruding sidewardly therefrom. The first rib is slidable against a first inner surface of the peripheral walls while the first side wall is separated a distance from the first inner surface. As a result, contacting areas of the actuator and corresponding inner surface are greatly reduced, and soldering materials, such as flux, originally influencing movement of the actuator can be avoided.

15 Claims, 5 Drawing Sheets

SWITCH WITH REDUCED CONTACTING AREAS BETWEEN ACTUATOR AND INSULATIVE HOUSING

BACKGROUND OF THE INVENTION

1. Field of the Invention

The present invention relates to a switch, and more particularly to a switch with reduced contacting areas between an actuator and an insulative housing during sliding.

2. Description of Related Art

Push-button switch is widely used in electronic devices via pressing its movable part to connect or disconnect internal circuits. Japanese Patent No. 4246119, issued to ALPS ELECTRIC CO., LTD. on Apr. 2, 2009 discloses a conventional push-button switch including an insulative housing, a frame enclosing the insulative housing, a plurality of contacts installed in the insulative housing and a button. The insulative housing defines an opening formed by a plurality of side walls for receiving a bottom portion of the button. Each side wall includes an inner surface exposed to the opening. When the button is pressed to move downwardly, most outer surfaces of the bottom portion slide against the inner surfaces of the insulative housing via large contacting areas.

However, since the profile of the push-button switch is low, during soldering process, soldering materials, such as flux, may easily enter into the opening and be deposited on the inner surfaces of the insulative housing. Under this condition, it may be difficult to drive the button because of large friction force coming from large contacting areas therebetween.

Hence, it is desired to provide an improved switch with reduced contacting areas between an actuator and an insulative housing.

BRIEF SUMMARY OF THE INVENTION

The present invention provides a switch including an insulative housing, at least one fixed contact retained in the insulative housing, a movable contact mounted to the insulative housing for alternatively contacting the at least one fixed contact, and an actuator slidably assembled to the insulative housing along a vertical direction. The insulative housing includes a plurality of peripheral walls and a receiving cavity enclosed by the peripheral walls. Each peripheral wall includes an inner surface exposed to the receiving cavity. The movable contact is located above the at least one fixed contact. The actuator includes a bottom portion received in the receiving cavity, a bottom operator for deforming of the moveable contact and a button extending oppositely to the bottom operator. The bottom portion includes a first side wall and a first rib protruding sidewardly from the first side wall. The first rib is slidable against a first inner surface of the peripheral walls while the first side wall is separated from the first inner surface by a gap which is located along a horizontal direction perpendicular to the vertical direction. As a result, contacting areas of the actuator and corresponding inner surface are greatly reduced, and soldering materials, such as flux, originally influencing movement of the actuator can be avoided.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
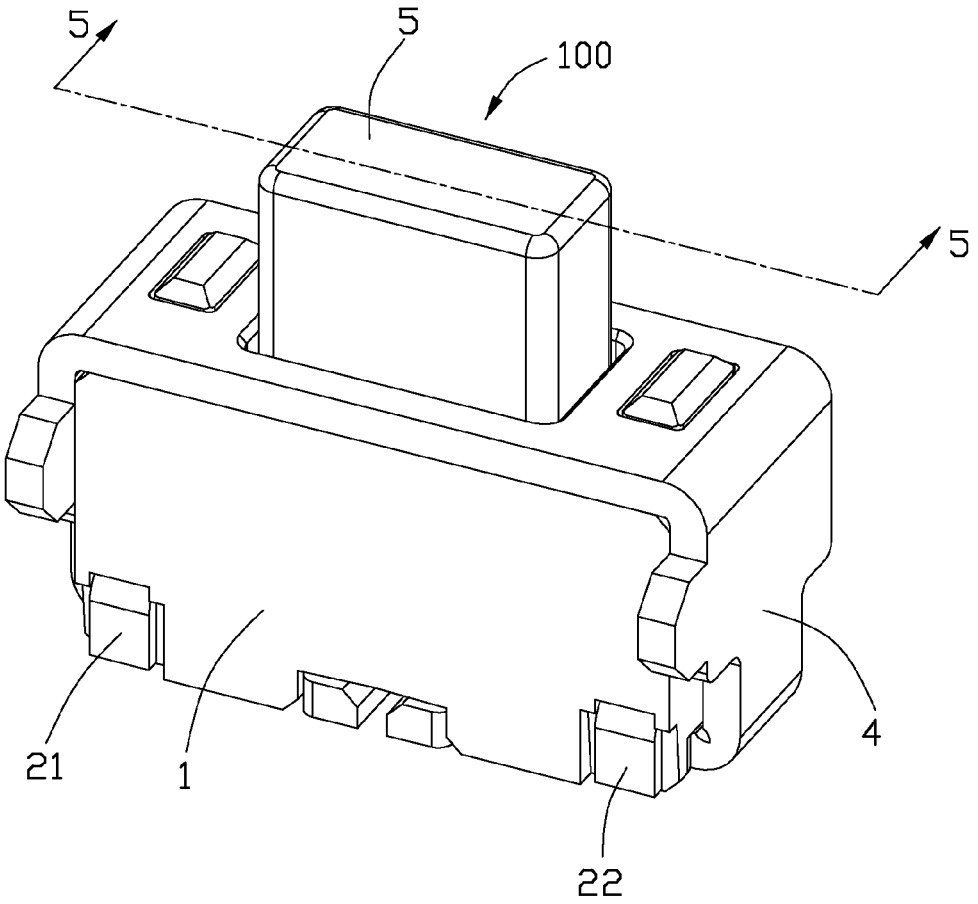
FIG. 1 is a perspective view of a switch in accordance with a preferred embodiment of the present invention.
Figure 2:
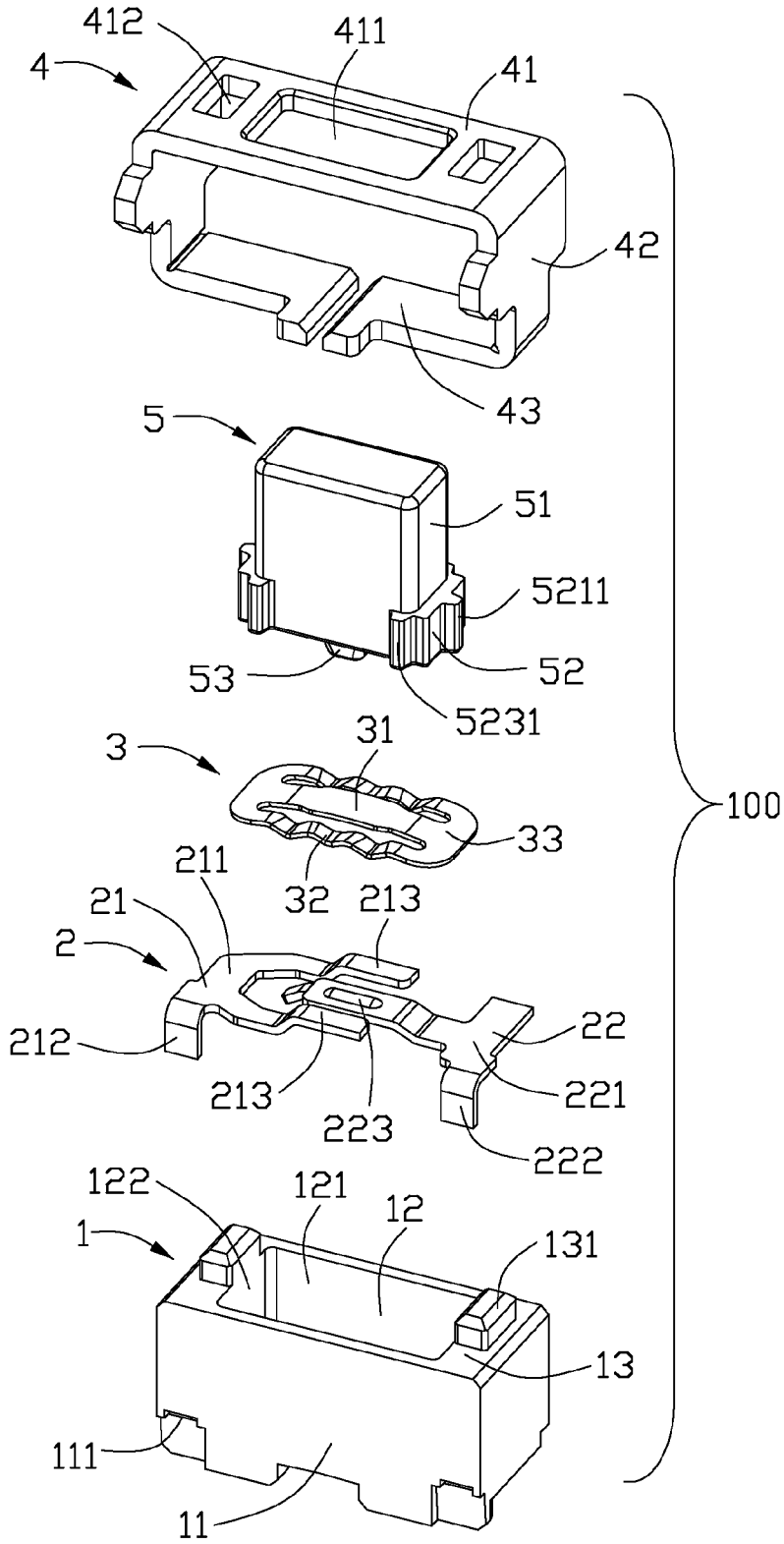
FIG. 2 is an exploded view of the switch as shown in FIG. 1.
Figure 3:
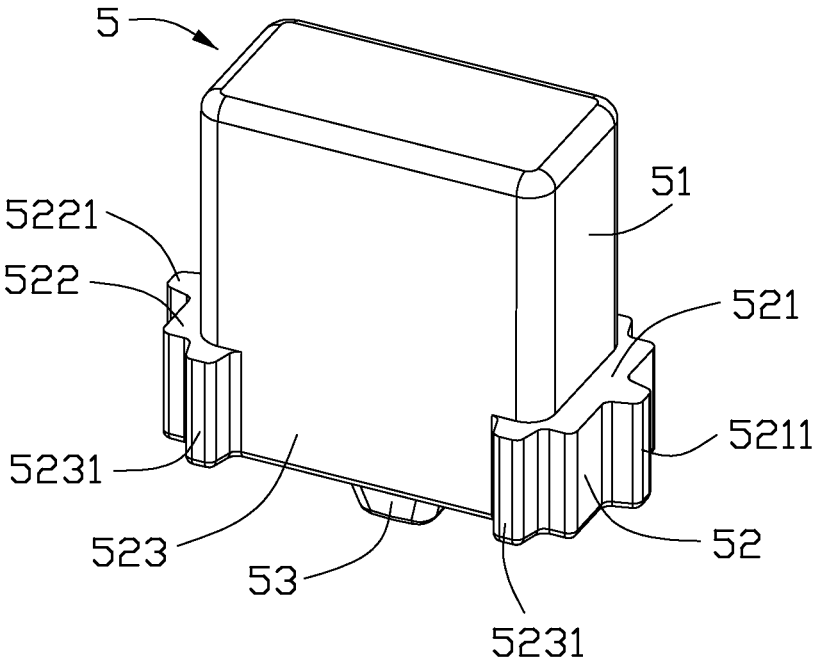
FIG. 3 is a perspective view of an actuator as shown in FIG. 2.

Reference will now be made to the drawing figures to describe the preferred embodiment of the present invention in detail. FIGS. 1 and 2 illustrate a kind of push-button switch 100 usually used in electronic devices. The switch 100 includes an insulative housing 1, a pair of fixed contacts 2 fixed in the insulative housing 1, a movable contact 3 installed in the insulative housing 1, an actuator 5 partly received in the insulative housing 1, and a top shell 4 enclosing the insulative housing 1.

Referring to FIGS. 2 to 5, the insulative housing 1 is box-shaped and includes a bottom wall (not labeled) and four side walls 11 extending upwardly from the bottom wall to jointly forming a receiving cavity 12. Each side wall 11 includes an inner surface 121 or 122 exposed to the receiving cavity 12. A pair of the opposite side walls 11 include a pair of locking blocks 131 extending upwardly therefrom for locking with the top shell 4. Besides, the insulative housing 1 defines a plurality of contact passageways 111 exposed to the exterior for mounting the fixed contacts 2.

The fixed contacts 2 include a first fixed contact 21 and a second fixed contact 22 separated from the first fixed contact 21. The first fixed contact 21 includes a U-shaped first fastening portion 211, a first soldering portion 212 bent downwardly from an edge of the first fastening portion 211, and a pair of forked first contacting sections 213 extending from distal ends of the first fastening portion 211. Each first contacting section 213 is higher than the first fastening portion 211 and has a flat surface. The second fixed contact 22 includes a second fastening portion 221, a second soldering portion 222 bent downwardly from the second fastening portion 221 and a cantilevered second contacting section 223 extending towards the first fixed contact 21. The second contacting section 223 includes a rib for improving the strength thereof and for stably contacting with the movable contact 3. After assembling, the second contacting section 223 is located between the first contacting sections 213, and the first and the second soldering portions 213, 223 both extend beyond the insulative housing 1 for being soldered to a PCB.

The movable contact 3 is located above the fixed contacts 2 and includes a sinuate first beam having a plurality of first contacting points 32, a sinuate second beam having a plurality of second contacting points 32, and a middle deformable beam 31 located between the first and the second beams. The first and the second contacting points 32 are adapted for contacting the first contacting sections 213. The middle deformable beam 31 is upwardly arced towards the actuator 5 and separated from the second contacting section 223, when the actuator 5 is not downwardly pressed by hand. However, once the actuator 5 is downwardly pressed, the middle deformable beam 31 is driven to contact the second contacting section 223 so as to establish electrically and mechanically connection of the first and the second fixed contacts 21, 22.

The actuator 5 includes a bottom portion 52 slidably received in the receiving cavity 12, a bottom operator 53 extending downwardly from the bottom portion 52 for deforming middle deformable beam 31 of the moveable contact 3, and a button 51 extending oppositely to the bottom operator 52. The bottom portion 52 includes a first side wall 521, a first rib 5211 extending sidewardly and outwardly from a middle section of the first side wall 521, a second side wall 522 opposite to the first side wall 521, a second rib 5221 extending sidewardly and outwardly from a middle section of the second side wall 522, a front wall 523, a pair of third ribs 5231 protruding forwardly from the front wall 523, a rear wall 524, and a pair of fourth ribs 5241 protruding rearwardly from the rear wall 524. The first and the second ribs 5211, 5221 are symmetrical with each other. The first and the second side walls 521, 522 each include a top surface and a bottom surface, and the first and the second ribs 5211, 5221 extend along the vertical direction and terminate at the top surface and the bottom surface. The third ribs 5231 are symmetrical to the fourth ribs 5241.

Figure 4:
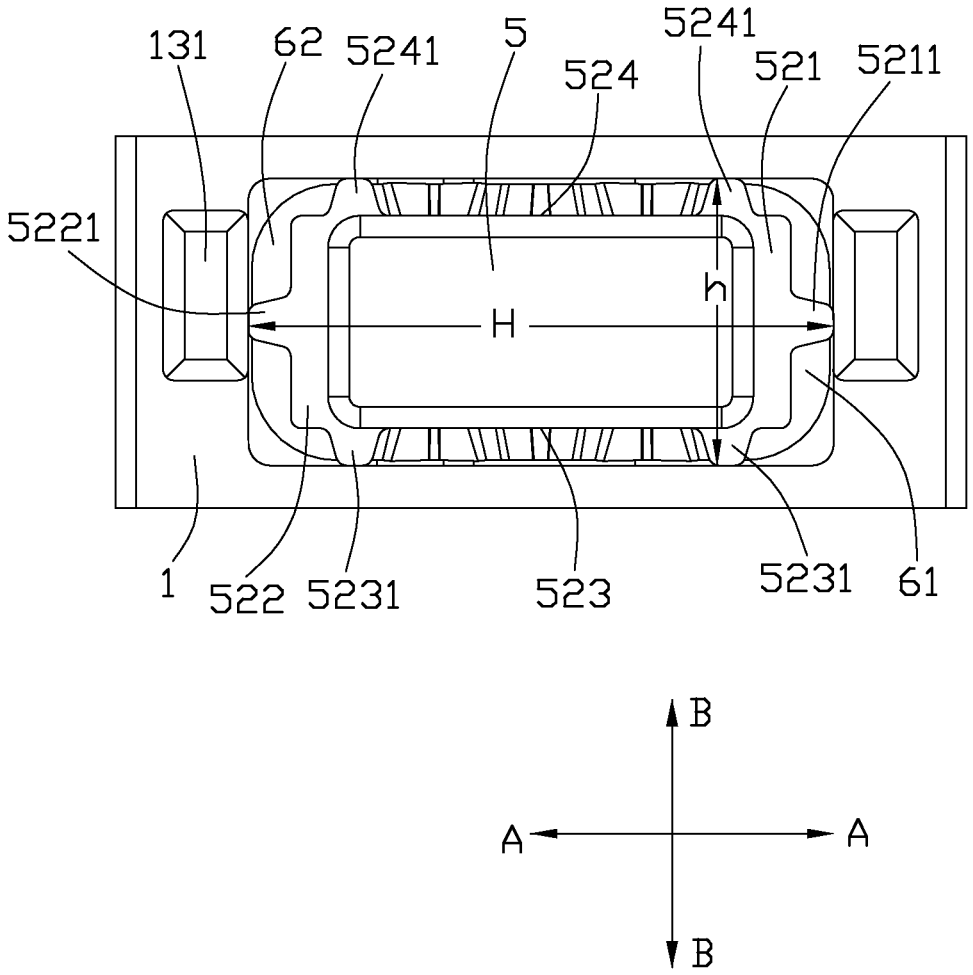
FIG. 4 is a top view of the switch as shown in FIG. 1 without a top shell.
Figure 5:
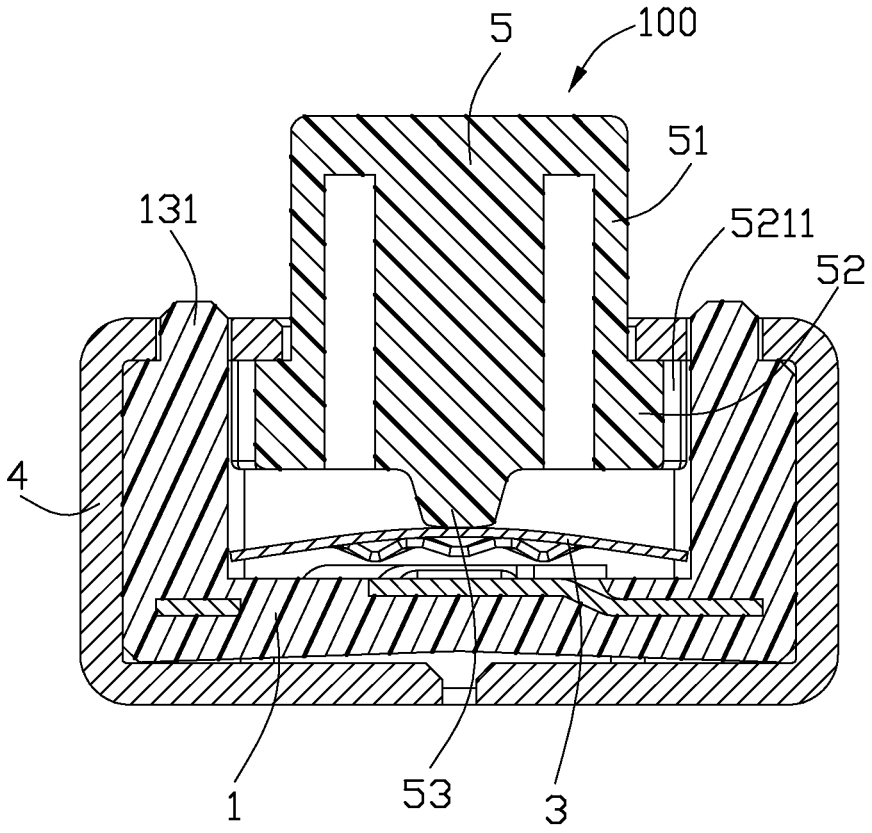
FIG. 5 is a cross-sectional view of the switch taken along line 5-5 of FIG. 1.

Referring to FIG. 4, a distance "H" between outmost edges of the first rib 5211 and the second rib 5221 along a longitudinal direction A-A is the same as that between the inner surfaces 122 along the longitudinal direction A-A, and similarly, a distance "h" between outmost edges of the third ribs 5231 and the fourth ribs 5241 along a transverse direction B-B is the same as that between the inner surfaces 121 along the transverse direction B-B. Both the longitudinal direction A-A and the transverse direction B-B are defined in a horizontal plane and are perpendicular with each other. However, the first side wall 521 is separated from the adjacent inner surface 122 by a gap 61 which is located along a horizontal direction perpendicular to the vertical direction. Similarly, the second side wall 522 is separated from the adjacent inner surface 122 by another gap 62 which is located along the horizontal direction perpendicular to the vertical direction as well. The front and the rear walls 523, 524 are separated from the adjacent inner surfaces 121, respectively.

When the bottom portion 52 slides in the receiving cavity 12 along the vertical direction, only the first, the second, the third and the fourth ribs 5211, 5221, 5231 and 5241 slide against the inner surfaces 121, 122, most parts of the bottom portion 52 are separated from the inner surfaces 121, 122. As a result, contacting areas of the bottom portion 52 and the corresponding inner surfaces 121, 122 are greatly reduced. In a preferred embodiment of the present disclosure, each of the ribs 5211, 5221, 5231, 5241 has an arced outer surface so that linear slide against the inner surfaces 121, 122 can be achieved. In soldering process, even if molten soldering materials, such as flux, enter into the receiving cavity 12 and is deposited on the inner surfaces 121, 122, the soldering materials may not essentially influence movement of the actuator 5 because contacting areas between the ribs 5211, 5221, 5231, 5241 and the inner surfaces 121, 122 are small. That is to say, the soldering materials originally influencing movement of the actuator 5 in the prior arts can be avoided according to the improvement of the present invention.

The top shell 4 includes a top wall 41, a bottom wall 43 opposite to the top wall 41 and a pair of side walls 42 connecting the top and the bottom walls 41, 43. Each side wall 42 is bent downwardly and perpendicular to the top wall 41. The bottom wall 43 includes separate parts extending towards each other. The top wall 41 defines a top opening 411 through which the button 51 extends and a pair of locking holes 412 at lateral sides of the top opening 411 for receiving the locking blocks 131. Since the bottom portion 52 is wider than the button 51, the bottom portion 52 is upwardly restricted by the top wall 41 along the vertical direction to prevent the actuator 51 from falling off from the top shell 4.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broadest general meaning of the terms in which the appended claims are expressed.

What is claimed is:

1. A switch comprising:

an insulative housing comprising a plurality of peripheral walls and a receiving cavity enclosed by the peripheral walls, each peripheral wall comprising an inner surface exposed to the receiving cavity;

at least one fixed contact retained in the insulative housing;

a movable contact installed in the insulative housing for alternatively contacting the at least one fixed contact, the movable contact being located above the at least one fixed contact; and an actuator slidably assembled to the insulative housing along a vertical direction, the actuator comprising a bottom portion received in the receiving cavity, a bottom operator for deforming the moveable contact and a button extending oppositely to the bottom operator, the bottom portion comprising a first side wall and a first rib protruding sidewardly from the first side wall; wherein the first rib is slidable against a first inner surface of the peripheral walls while the first side wall is separated from the first inner surface by a gap which is located along a horizontal direction perpendicular to the vertical direction; and wherein the at least one fixed contact comprises a first fixed contact having a pair of forked first contacting sections and a second fixed contact having a second contacting section located between the pair of forked first contacting sections, the movable contact comprising a first beam having a plurality of contact points contacting one of the first contacting sections, a second beam having a plurality of another contact points contacting the other of the first contacting sections, and a middle deformable beam driven by the bottom operator for alternatively contacting the second contacting section.

2. The switch as claimed in claim 1, wherein the first side wall comprises a top surface and a bottom surface, the first rib extending along the vertical direction and terminating at the top surface and the bottom surface.

3. The switch as claimed in claim 2, wherein the first rib protrudes sidewardly from a middle section of the first side wall.

4. The switch as claimed in claim 1, wherein the bottom portion comprises a second side wall opposite to the first side wall and a second rib protruding sidewardly from the second side wall, the inner surfaces comprising a second inner surface against which the second rib is slidable, the second side wall being separated from the second inner surface by another gap which is located along the horizontal direction perpendicular to the vertical direction as well.

5. The switch as claimed in claim 4, wherein a distance between the first inner surface and the second inner surface along a longitudinal direction is the same as that between outmost edges of the first rib and the second rib along the longitudinal direction.

6. The switch as claimed in claim 4, wherein bottom portion comprises at least one third rib and at least one fourth rib protruding outwardly from front and rear sides of the bottom portion, respectively, the inner surfaces comprising a third inner surface against which the third rib is slidable and a fourth inner surface against which the fourth rib is slidable.

7. The switch as claimed in claim 6, wherein a distance between the third inner surface and the fourth inner surface along a transverse direction perpendicular to the longitudinal direction is the same as that between outmost edges of the third rib and the fourth rib along the transverse direction.

8. The switch as claimed in claim 6, wherein a pair of third ribs and a pair of fourth ribs are formed protruding outwardly from front and rear sides of the bottom portion, respectively.

9. The switch as claimed in claim 1, further comprising a top shell covering the insulative housing, the top shell defining a top opening through which the button extends, the bottom portion being wider than the button so as to be restricted by the top shell along the vertical direction.

10. A switch comprising:

an insulative housing defining a receiving cavity enclosed by a plurality of peripheral walls, each peripheral wall comprising an inner surface exposed to the receiving cavity;

a fixed contact retained in the insulative housing;

a movable contact installed in the insulative housing for alternatively contacting the fixed contact; and an actuator comprising a bottom portion slidably received in the receiving cavity, a bottom operator for deforming the moveable contact and a button extending oppositely to the bottom operator, the bottom portion comprising a first side wall and a first rib protruding sidewardly from the first side wall; wherein the first rib is linearly slidable against a first inner surface of the peripheral walls while the first side wall is separated a distance from the first inner surface; and wherein the at least one fixed contact comprises a first fixed contact having a pair of forked first contacting sections and a second fixed contact having a second contacting section located between the pair of forked first contacting sections, the movable contact comprising a first beam having a plurality of contact points contacting one of the first contacting sections, a second beam having a plurality of another contact points contacting the other of the first contacting sections, and a middle deformable beam driven by the bottom operator for alternatively contacting the second contacting section.

11. The switch as claimed in claim 10, wherein the first side wall comprises a top surface and a bottom surface, the first rib extending along the vertical direction and terminating at the top surface and the bottom surface, the first rib comprising an arced outer surface to engage with the first inner surface.

12. The switch as claimed in claim 10, wherein the bottom portion comprises a second side wall opposite to the first side wall and a second rib protruding sidewardly from the second side wall, the inner surfaces comprising a second inner surface against which the second rib is linearly slidable, the second side wall being separated a distance from the second inner surface.

13. The switch as claimed in claim 12, wherein a distance between the first inner surface and the second inner surface along a longitudinal direction is the same as that between outmost edges of the first rib and the second rib along the longitudinal direction.

14. The switch as claimed in claim 12, wherein bottom portion comprises at least one third rib and at least one fourth rib protruding outwardly from front and rear sides of the bottom portion, respectively, the inner surfaces comprising a third inner surface against which the third rib is linearly slidable and a fourth inner surface against which the fourth rib is linearly slidable.

15. The switch as claimed in claim 10, further comprising a top shell covering the insulative housing, the top shell defining a top opening through which the button extends, the bottom portion being wider than the button so as to be restricted by the top shell along the vertical direction.

* * * * *